US006530346B1

(12) United States Patent
Coones et al.

(10) Patent No.: US 6,530,346 B1
(45) **Date of Patent: *Mar. 11, 2003**

(54) NON-DILUTION AIR WATER HEATER BLOWER

(75) Inventors: Lyn D. Coones, Cassville, MO (US); William S. Gatley, Cassville, MO (US)

(73) Assignee: Fasco Industries, Inc., Cassville, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/997,418

(22) Filed: Nov. 29, 2001

Related U.S. Application Data

(60) Provisional application No. 60/250,612, filed on Dec. 1, 2000.

(51) Int. Cl.[7] ..... F04B 19/24
(52) U.S. Cl. ..... 122/4 R; 417/360
(58) Field of Search ..... 122/13.01, 4 R; 415/206, 203; 417/360, 423.15

(56) References Cited

U.S. PATENT DOCUMENTS

| | | | | |
|---|---|---|---|---|
| 4,840,222 A | | 6/1989 | Lakin et al. | 165/47 |
| 4,865,517 A | | 9/1989 | Beehler | 415/214.1 |
| 5,040,943 A | | 8/1991 | Dwyer et al. | 415/26 |
| 5,352,099 A | | 10/1994 | Anstine et al. | 417/366 |
| 5,375,651 A | | 12/1994 | Colwell | 165/47 |
| 5,551,836 A | | 9/1996 | Roth et al. | 415/204 |
| 5,839,374 A | | 11/1998 | Conner et al. | 110/162 |
| 6,135,731 A | | 10/2000 | Woollen weber et al. | 417/423.14 |
| 6,231,311 B1 | * | 5/2001 | Gatley et al. | 122/17.1 |
| 6,296,478 B1 | | 10/2001 | Gatley, Jr. | 432/77 |
| 6,318,358 B1 | | 11/2001 | Gatley, Jr. | 126/110 |
| 6,398,512 B2 | * | 6/2002 | Stewart | 417/53 |

* cited by examiner

*Primary Examiner*—Jiping Lu
(74) *Attorney, Agent, or Firm*—Andrus, Sceales, Starke & Sawall, LLP

(57) ABSTRACT

A non-dilution air water heater blower for use in expelling exhaust gases from a water heater. The water heater blower includes a one piece blower housing defined by an outer wall having an upper section and a lower section. An inlet plate is positioned between the upper section and the lower section of the blower housing to define an upper chamber and a lower chamber. The lower chamber of the blower housing surrounds the exhaust flue from the water heater. A blower motor is attached to the outside surface of the blower housing. A rotating impeller coupled to the blower motor and positioned in the upper chamber draws exhaust gases from the water heater into the lower chamber through an inlet aperture formed in the inlet plate and out of an exhaust outlet formed in the upper chamber.

25 Claims, 4 Drawing Sheets

FIG. 5
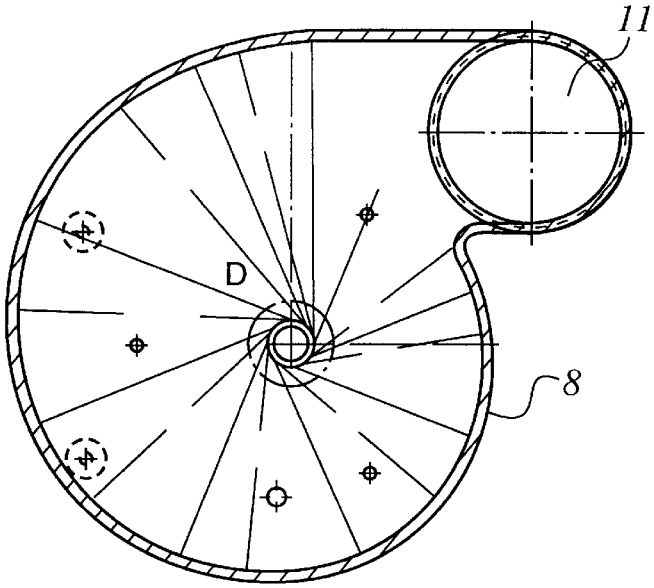
SCROLL LAYOUT
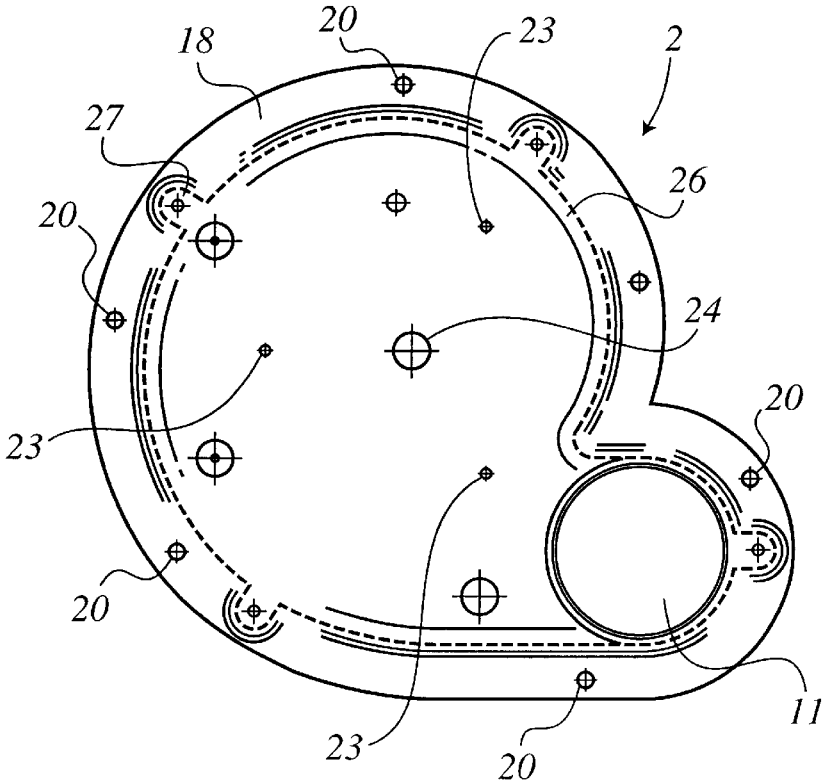
FIG. 6

NON-DILUTION AIR WATER HEATER BLOWER

CROSS-REFERENCE TO RELATED APPLICATION

This application is based on and claims priority to U.S. Provisional Patent Application Ser. No. 60/250,612, filed on Dec. 1, 2000.

BACKGROUND OF THE INVENTION

This invention relates generally to draft inducers for hot water heaters. More particularly, the present invention relates to a blower design for expelling flue gases emanating from conventional hot water heaters.

Water heaters have been around for many years to provide a supply of heated water for both commercial and consumer usage. To generate the requisite thermal energy needed to increase the temperature of the water therein, a gas or oil fired burner is commonly employed. The burner produces hot combustion gases or flue gases, which need to be expelled from the water heater.

To minimize heat losses and maximize the overall efficiency of the water heater, it is desirable to have the heated flue gases flow through the water heater via the most rigorous path possible. Essentially, the more rigorous the path is, the more heat (energy) can be recovered from the flue gases and transferred to the water.

Presently, the vast majority of commercial water heaters rely on the chimney effect to draw flue gases up the center flue and out the chimney. Because the chimney effect relies on natural ventilation, water heaters must be designed to incorporate a less rigorous path through the flue, which sacrifices efficiency.

In some instances, centrifigal blowers have been engineered into the hot water heating system to move the gases through the water heater. The use of a blower allowed the most rigorous path possible for the flue, which in turn increased the amount of heat transferred from the flue gases to the water. However, the addition of a centrifugal blower significantly increased the overall cost and complexity of the water heating system through the use of intricate plumbing layouts and multiple piece blower housings. Furthermore, these blowers introduced dilution air into the system, which required a more powerful motor, thereby reducing the overall savings realized by recovering more heat from the flue gases.

Another problem with these blower/water heater systems was that exhaust fumes could potentially make contact with the blower motor, thereby causing the blower motor to overheat, which affected the longevity of the motor and overall efficiency of the blower unit. Also, exhaust gases contacting the motor were able to leak into the ambient environment, thereby creating various health risks due to the toxicity of the exhaust fumes.

The present invention solves many of the problems regarding the plumbing of the hot exhaust gases inside of and outside of the water heater. Additionally, the instant invention reduces production and maintenance costs while increasing the overall safety, efficiency and durability of the water heater heating system.

SUMMARY OF THE INVENTION

Accordingly, it is an object of the present invention to provide a water heater blower unit that is cost effective to manufacture, assemble and maintain.

An additional object of the present invention is to increase the overall efficiency of a conventional hot water heater by allowing for the implementation of a more rigorous flue path to maximize the amount of heat that can be recovered from the heated gases traveling therein.

A further object of the present invention is to provide a blower motor assembly that seals on the full circumference of its mounting base and easily mounts atop a conventional hot water heater to facilitate and maximize the potential to draw exhaust gases through and away from the water heater while minimizing the amount of motor power required to drive the system.

Still yet another object of the present invention is to keep exhaust gases from making contact with the blower motor and leaking into the surrounding atmosphere.

The present invention achieves the objectives set forth above by providing an improved motor blower assembly as described herein. The motor blower assembly of the present invention includes a scroll-shaped blower housing that mounts and seals atop a conventional hot water heater and is sized to fit between the heater's inlet and outlet water pipes. The blower housing is not vented, in order to maximize the amount of negative pressure needed to draw flue gases out of the water heater.

The one-piece blower housing has three apertures on its top surface to receive bolts to secure a conventional motor to the blower housing, and one radially centered aperture to receive a motor shaft. The blower housing has portions defining an upper chamber for receiving an impeller. The impeller is fixed to a motor shaft attached to the rotor of the motor. Additionally, the housing has portions which define a vertical outlet that is in fluid communication with the upper chamber. The outlet provides egress for exhaust gases emanating from a hot water heater to which the blower is designed to be attached.

A blower inlet plate is provided which is positioned internal within the blower housing at an intermediate location along a sidewall of the housing. The inlet plate includes an inlet aperture that creates a vertical inlet through which exhaust gases exiting the hot water heater enter the upper chamber. The combination of the inlet plate, the lower sidewall of the blower housing and the top of the water heater form a lower chamber within which a flue pipe of the hot water heater is confined. The lower chamber is in fluid communication with the upper chamber of the blower housing via the inlet aperture of the blower inlet plate.

When the impeller is rotated, a negative pressure is created in the upper chamber of the blower housing. This negative pressure draws exhaust gases through and out of the hot water heater and into the lower chamber. The gases are then drawn into the upper chamber through the inlet aperture of the inlet plate, where they are forced through the vertical outlet of the blower housing.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 5 shows the scroll layout of the blower housing sidewall;

FIG. 6 shows a bottom view of the blower housing of the present invention;

DETAILED DESCRIPTION OF THE INVENTION

Figure 1:
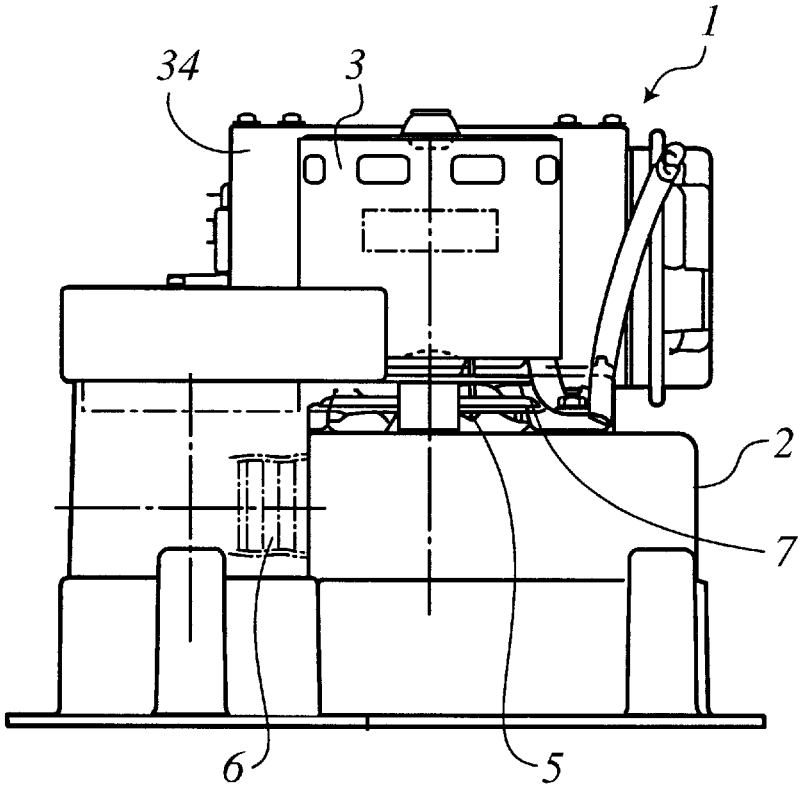
FIG. 1 is a side view of the non-dilution air water heater blower constructed in accordance with the invention.

At the outset, the invention is described in its broadest overall aspects with a more detailed description following. Accordingly, a conventional hot water heater typically includes a combustion air inlet, a combustion air chamber, a heat recovery section, a draft inducer and a combustion gas exhaust. When the water heater is in operation, the draft inducer or water heater blower creates a negative pressure or induces a draft in the water heater so that air for combustion is drawn into the combustion chamber. Once in the combustion chamber, the air is mixed with a fuel such as natural gas for combustion or burning (i.e., the heat energy source). The heat energy of the combustion process is then extracted from the combustion or exhaust gases (flue gases) in the heat recovery section, which also results in the reduction in the temperature of the gases.

After passing through the heat recovery section of the water heater, the relatively cooler combustion gases are drawn into the water heater blower by the rotation of an impeller or rotating blades within the blower. The rotation of the impeller or rotating blades of the blower creates the draft that draws the air for combustion into the hot water heater and that draws the combustion gases through the water heater and into the heat recovery sections. The combustion gases are then expelled via the water heater blower through an exhaust pipe out to the atmosphere.

To provide an even, efficient flow of gases, it is important that the housing for the blower be adequately sealed so that gases are drawn into the blower at an inlet and exhausted at an outlet. Any leaks in the housing will inevitably lead to the inefficiency and incomplete removal of combustion gases. Additionally, it is imperative that the combustion gases are not allowed to escaped into the ambient, as these gases may be toxic.

Equally important is a means to cool the blower motor during operation. To provide effective cooling while preventing hot exhaust gases from entering into the motor housing (i.e., to prevent the exhaust gases from heating the motor), the blower motor housing is strategically separated from the blower housing such that the pressure at the point where the blower motor shaft enters the blower housing is maintained at a slight vacuum. Furthermore, a cooling fan housed in a vented mounting plate is attached to the motor shaft to draw air through the motor assembly.

To accomplish all of these functions as well as others, a new non-dilution air water heater blower has been devised incorporating a unique one-piece blower housing. The housing is designed so that two chambers are formed which are in fluid communication with one another. An upper chamber located in the upper section of the housing encompasses the impeller, while a lower chamber located in the lower section of the housing, houses the water heater flue. Separating the chambers is an inlet plate having an inlet aperture to allow flue gases to pass from the lower chamber to the upper chamber.

Referring to FIGS. 1–4, a non-dilution air water heater blower 1 is shown which provides a blower motor assembly 3 and blower housing 2 that attaches directly to a hot water heater (not shown).

Figure 3:
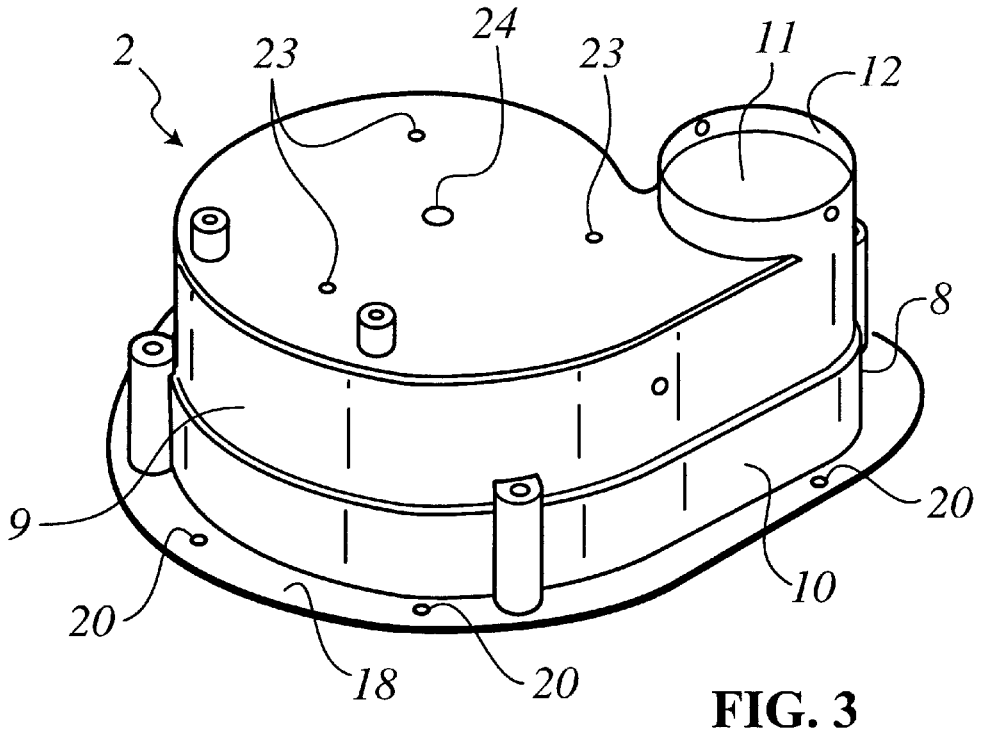
FIG. 3 shows an isometric view of the blower housing of the present invention.

The non-dilution air water heater blower 1 includes a blower housing 2 adapted to receive a conventional blower motor 3. As shown in FIG. 3, motor mounting bores 23 are provided on the top surface of the blower housing 2 for receiving mechanical fasteners (not shown) to secure the blower motor 3 to the blower housing 2. Additionally, the top surface of the blower housing 2 includes an aperture 24 for receiving a motor shaft. The blower motor 3 is positioned on the outside of the blower housing 2 to prevent flue gases emanating from the water heater from making contact with the blower motor 3 and to further prevent the blower motor 3 from overheating.

Figure 2:
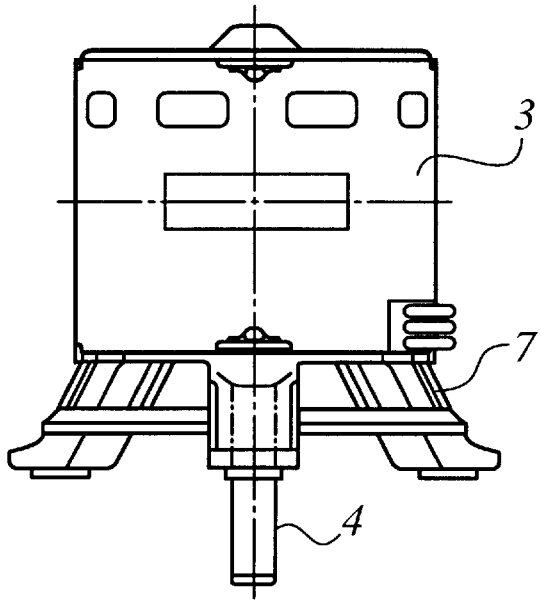
FIG. 2 shows a side view of the blower motor assembly of the present invention.

As seen in FIGS. 1 and 2, the blower motor 3 has a motor shaft 4 for receiving a cooling fan 5 and an impeller 6. At the base of the motor 3 is a vented shroud 7 configured to enclose the cooling fan 5. Attached to motor shaft 4 is the cooling fan 5, which can be freely rotated within vented shroud 7 in order to cool the motor during operation. Also attached to the motor shaft 4 is the impeller 6, which can be freely rotated within the non-dilution air water heater blower 1.

Figure 4:
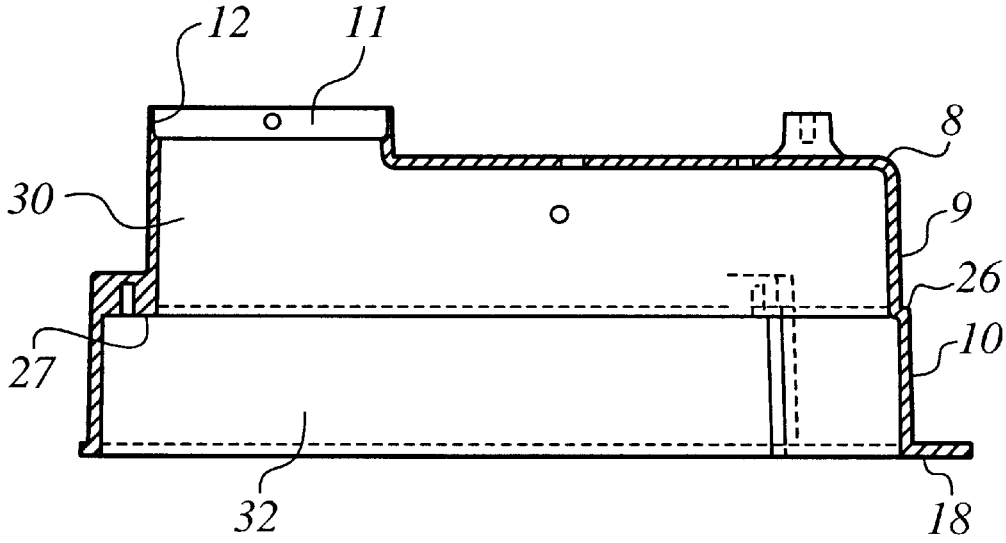
FIG. 4 shows a side view of the blower housing of the present invention.

As seen in FIGS. 3 and 4, the blower housing 2 has a blower housing sidewall 8 within which the impeller 6 is situated. The sidewall 8 is a unitary element that defines two sections of the blower housing 2, an upper section 9 and a lower section 10. As best seen in FIG. 5, the blower housing 2 preferably has an inner surface that is scroll-shaped to maximize the efficient flow of exhaust gases into an exhaust outlet 11 formed in the blower housing 2.

Referring to FIG. 4, the exhaust outlet 11 preferably has a shoulder 12, which is provided as a seat to an exhaust pipe (not shown) used to channel the exhaust gases out of an enclosed structure, such as a house basement.

Referring now to FIGS. 3 and 4, the blower housing 2 is shown which is adapted to fit about the infeed and outfeed water lines of a hot water heater. A mounting flange 18 extends radially from the lower section of the housing sidewall 10 so that the blower housing 2 can be positioned flush with respect to the top surface of the water heater. Flange bores 20 (also shown in FIG. 6) are provided for securing and sealing the blower housing 2 to the top of a hot water heater (not shown) with any of a variety of fasteners. By design, the blower housing 2 of the present invention is secured directly to the top of a hot water heater and forms a seal around the full circumference of its mounting base. Additionally, the blower housing 2 is configured such that an exhaust flue (not shown) that extends above the top surface of the hot water heater protrudes into the lower chamber 32 of the blower housing 2 (the upper and lower chambers will be described in more detail below).

Turning to FIG. 6, a bottom view of the blower housing 2 is shown. An inlet shoulder 26 is formed (preferably scroll-shaped) to allow for the efficient flow of exhaust gases toward exhaust outlet 11. The inlet shoulder 26 includes a plurality of recessed mounting ledges 27, as shown in FIGS. 4 and 6.

Figure 7:
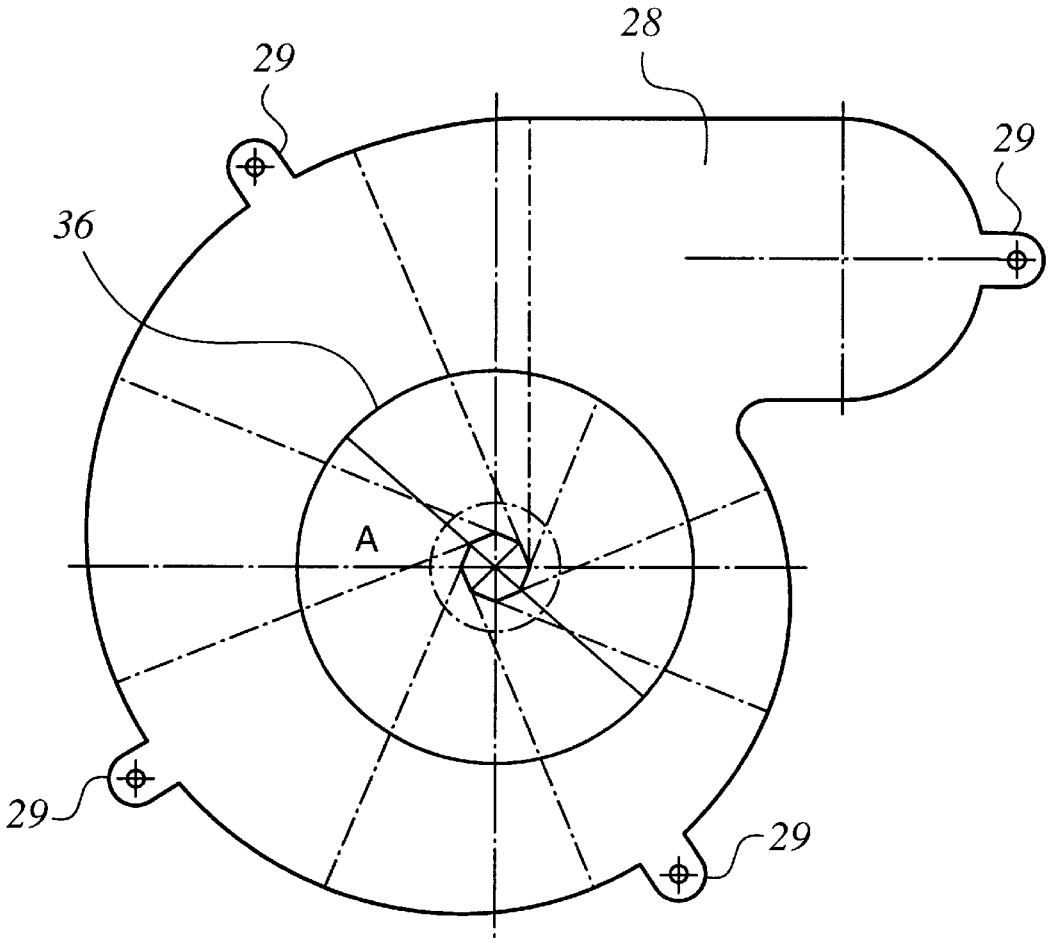
FIG. 7 shows a bottom view of the inlet plate in accordance with the invention.

An inlet plate 28, shown in FIG. 7, which is sized and shaped to fit within the blower housing 2, is secured to the inlet should 26 with any of a variety of attachment methods such as clips, mechanical fasteners, adhesives, mating locking surfaces, etc. The method to secure the inlet plate 28 to the blower housing 2 is not particularly important so long as the seal between the blower housing 2 and the inlet plate 28 is tight. In the embodiment of the invention illustrated, the inlet plate 28 includes a plurality of ears 29 that are each supported by and attached to one of the mounting ledges 27.

When the inlet plate 28 is installed in the blower housing 2, an upper chamber 30 (FIG. 4) for housing the impeller 6 is formed by the combination of the upper section of the blower housing sidewall 9, the top section of the blower housing 2, and the inlet plate 28. A lower chamber 32 (FIG. 4) for housing the water heater flue, is formed by the combination of the lower section of the blower housing sidewall 10, the top of the water heater to which the blower unit is directly attached (not shown), and the inlet plate 28. Thus, the inlet plate 28 separates the upper and lower chambers 30, 32 of the blower housing 2. Referring back to FIG. 7, the inlet plate 28 includes an inlet aperture 36 that defines an opening through the inlet plate 28. When the inlet plate 28 is installed in the blower housing 2, the inlet aperture 36 keeps the lower chamber 32 in fluid communication with the upper chamber 30.

Attached to the blower housing 2 is an optional auxiliary box 34 (FIG. 1) for housing the water heater and non-dilution air blower controls and is affixed to the blower housing 2 opposite the exhaust outlet 11.

Having described the components of the non-dilution air water heater blower 1, attention will now be drawn its operation. Operation of the blower motor 3 causes the rotation of the impeller 6 and the motor cooling fan 5. Rotation of the cooling fan 5 cools the motor. Rotation of the impeller 6 generates negative air pressure in the upper and lower chambers 30, 32 which causes flue gases to be drawn through a rigorous flue path inside the water heather (not shown). As the heated gases traverse the rigorous flue path, heat is transferred from the gases to the water, which significantly reduces the temperature of the gases and increases the water temperature, thereby boosting the efficiency of the water heater. The reduced temperature gases then exit the flue and enter the lower chamber 30 of the blower housing 2. The gases are then drawn into the upper chamber 32 of the blower housing 2 through the inlet 36 of the inlet plate 28. Finally, the rotation of the impeller 6 drives the flue gases into the exhaust outlet 11 for final expulsion from the hot water heating system. Additionally, the rotation of the impeller 6 creates a slight vacuum at the point where the motor shaft 4 passes into the blower housing 2, thus preventing heated exhaust gases from coming in contact with the blower motor 3.

Key to the operation of the non-dilution air water heater blower 1 is the fact that the blower housing 2 is not vented and fully seals over the water heater flue (not shown). This maximizes the amount of heat (energy) recovered from the hot flue gases by allowing for the implementation of more rigorous flue path designs, and minimizes the amount of motor power (energy) required to draw the flue gases through the water heater/blower system.

It is to be understood that the present invention is by no means limited to the particular constructions herein disclosed and/or shown in the drawings, but also comprises any modifications or equivalents within the scope of the claims.

Various alternatives and embodiments are contemplated as being within the scope of the following claims particularly pointing out and distinctly claiming the subject matter regarded as the invention.

We claim:

1. A non-dilution air water heater blower for expelling exhaust gases from a water heater, the blower comprising:

a blower housing defined by an outer wall, the outer wall having an upper section and a lower section;

a blower motor having a motor shaft wherein the blower motor is mounted to the outside of the blower housing to prevent exhaust gases from contacting the motor;

an inlet plate mountable within the blower housing between the upper section and the lower section, wherein a top surface of the inlet plate and the upper section of the blower housing outer wall define an upper chamber and a bottom surface of the inlet plate and the lower section of the blower housing outer wall define a lower chamber, wherein the inlet plate includes an inlet aperture that allows for fluid communication between the upper chamber and the lower chamber; and an impeller secured to the motor shaft and situated in the upper chamber such that the impeller can freely rotate within the upper chamber to draw exhaust gases from the water heater into the upper chamber.

2. The non-dilution air water heater blower of claim 1 wherein the blower housing is a one-piece blower housing.

3. The non-dilution air water heater blower of claim 1 wherein the blower housing is not vented to maximize the negative pressure generated by the impeller.

4. The non-dilution air water heater blower of claim 1 wherein the upper chamber is scroll-shaped.

5. The non-dilution air water heater blower of claim 1 wherein the blower housing further comprises portions defining an exhaust outlet that is in fluid communication with the upper chamber.

6. The non-dilution air water heater blower of claim 1 wherein the blower housing further includes a shoulder formed between the upper section and the lower section of the blower housing outer wall.

7. The non-dilution air water heater blower of claim 6 wherein the inlet plate is secured to the shoulder formed in the outer wall of the blower housing.

8. The non-dilution air water heater blower of claim 6 wherein the lower section of the housing sidewall has a radially extended flange around its circumference.

9. The non-dilution air water heater blower of claim 1 wherein an auxiliary control box is attached to the blower housing.

10. A non-dilution air water heater blower/water heater assembly comprising;

a water heater comprising a top surface, at least one water pipe and an exhaust flue; and a non-dilution air water heater blower attached to the top surface of the hot water heater comprising;

a blower housing defined by an outer wall, the outer wall having an upper section and a lower section;

a blower motor having a motor shaft wherein the blower motor is mounted to the outside of the blower housing to prevent exhaust gases from contacting the motor;

an inlet plate mountable within the blower housing between the upper section and the lower section, wherein a top surface of the inlet plate and the upper section of the blower housing outer wall define an upper chamber and a bottom surface of the inlet plate and the lower section of the blower housing outer wall define a lower chamber, wherein the inlet plate includes an inlet aperture that allows for fluid communication between the upper chamber and the lower chamber; and an impeller secured to the motor shaft and situated in the upper chamber such that the impeller can freely rotate within the upper chamber to draw exhaust gases from the water heater into the upper chamber.

11. The non-dilution air water heater blower/water heater assembly of claim 10 wherein the blower housing is a one-piece blower housing.

12. The non-dilution air water heater blower/water heater assembly of claim 10 wherein the blower housing is not vented to maximize the negative pressure generated by the impeller.

13. The non-dilution air water heater blower/water heater assembly of claim 10 wherein the upper chamber is scroll-shaped.

14. The non-dilution air water heater blower/water heater assembly of claim 10 wherein the blower housing further comprises portions defining an exhaust outlet that is in fluid communication with the upper chamber.

15. The non-dilution air water heater blower/water heater assembly of claim 10 wherein the blower housing further includes a shoulder formed between the upper section and the lower section of the blower housing outer wall.

16. The non-dilution air water heater blower/water heater assembly of claim 15 wherein the inlet plate is secured to the shoulder formed in the outer wall of the blower housing.

17. The non-dilution air water heater blower/water heater assembly of claim 15, wherein the lower section of the housing sidewall has a radially extended flange around its circumference, the flange acting to secure and seal the non-dilution air water heater blower to the water heater.

18. The non-dilution air water heater blower/water heater assembly of claim 10 wherein an auxiliary control box is attached to the blower housing.

19. A method of drawing flue gases through and out of a conventional hot water heater to boost the efficiency of the water heater comprising the steps of:

providing a conventional hot water heater comprising a top surface, at least one water pipe and an exhaust flue;

providing a non-dilution air water heater blower attached to the top surface of the water heater comprising:

a blower housing, the blower housing forming an upper chamber and an exhaust outlet that is in fluid communication with the upper chamber;

a blower motor having a motor shaft extending into the blower housing, wherein the blower motor is mounted to the outside of the blower housing to prevent exhaust gases from contacting the motor to further prevent the motor from overheating;

an impeller secured to the motor shaft and situated in the upper chamber such that the impeller can freely rotate within the upper chamber; and an inlet plate having an inlet aperture, wherein the inlet plate is positioned within the blower housing to form a bottom surface of the upper chamber and wherein the combination of the inlet plate, the blower housing, and the top surface of the water heater form a lower chamber which is in fluid communication with the upper chamber;

rotating the impeller to develop negative air pressure in the upper chamber to draw flue gases from the lower chamber into the upper chamber;

generating negative air pressure in the lower chamber to draw flue gases through the water heater flue via the most rigorous path possible to maximize the amount of heat recovered from the flue gases and transferred to the water inside the water heater;

drawing the gas mixture into the upper chamber from the lower chamber via the inlet aperture in the inlet plate;

expelling the gas mixture from the non-dilution air water heater blower via the exhaust outlet.

20. The method of claim 19 wherein the blower housing is a one-piece blower housing.

21. The method of claim 19 wherein the blower housing is not vented to maximize the negative pressure generated by the impeller.

22. The method of claim 19 wherein the upper chamber is scroll-shaped.

23. The method of claim 19 wherein the blower housing has a radially extended flange at its base, the radially extended flange acting to secure and seal the non-dilution air water heater blower to the water heater.

24. The method of claim 19 wherein the non-dilution air water heater blower is secured to the water heater such that the blower housing fully seals over the water heater flue.

25. The method of claim 19 wherein the non-dilution air water heater blower is secured to the water heater such that the exhaust flue is positioned above the lowest point of the lower chamber and below the lowest point of the upper chamber.

* * * * *